US008186108B1

(12) United States Patent
Culpepper

(10) Patent No.: US 8,186,108 B1
(45) **Date of Patent: *May 29, 2012**

(54) MODULAR MEDICAL SERVICES UNIT WITH SECURE CONSOLE

(75) Inventor: Taylor C. Culpepper, Oklahoma City, OK (US)

(73) Assignee: Modular Services Co., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/077,409

(22) Filed: Mar. 31, 2011

Related U.S. Application Data

(63) Continuation of application No. 12/100,862, filed on Apr. 10, 2008, now Pat. No. 7,971,396.

(60) Provisional application No. 60/910,862, filed on Apr. 10, 2007.

(51) Int. Cl.
*E04F 13/00* (2006.01)
*A47F 10/00* (2006.01)
*E04C 2/52* (2006.01)

(52) U.S. Cl. ..... 52/27; 52/36.1; 52/220.7

(58) Field of Classification Search ..... 52/27, 28, 52/36.1, 36.4, 220.7, 220.8, 239; 211/26; 49/38–41, 125

See application file for complete search history.

(56) References Cited

U.S. PATENT DOCUMENTS 3,521,936 A * 7/1970 Coker, Jr. ..... 312/209
4,121,523 A * 10/1978 Hastings ..... 109/2
5,044,135 A * 9/1991 Kroon et al. ..... 52/239
5,184,601 A * 2/1993 Putman ..... 600/102
5,186,337 A * 2/1993 Foster et al. ..... 211/26
5,448,859 A * 9/1995 Walker et al. ..... 52/38
5,644,876 A * 7/1997 Walker ..... 52/220.7
5,687,513 A * 11/1997 Baloga et al. ..... 52/32
6,044,852 A * 4/2000 Epperson et al. ..... 134/56 R
6,430,882 B1 * 8/2002 Feldpausch et al. ..... 52/220.7
6,668,493 B1 * 12/2003 Walker ..... 52/27
6,817,149 B2 * 11/2004 Diffrient et al. ..... 52/239
7,065,811 B2 * 6/2006 Newkirk et al. ..... 5/600
7,204,714 B2 * 4/2007 Walker et al. ..... 439/532
7,227,081 B2 * 6/2007 Bally et al. ..... 174/53
7,254,850 B2 * 8/2007 Newkirk et al. ..... 5/600
7,425,679 B2 * 9/2008 Kasten et al. ..... 174/53
2003/0177713 A1 * 9/2003 Walker et al. ..... 52/79.1

* cited by examiner

*Primary Examiner* — Jessica Laux
*Assistant Examiner* — Elizabeth A Plummer
(74) *Attorney, Agent, or Firm* — Mary M. Lee

(57) ABSTRACT

A medical services unit for use in health care facilities where high security is required, such as in prison and psychiatric hospitals. The unit comprises a floor-to-ceiling column with an internal medical services section to provide a plurality of medical services. The medical services section is protected by a rotating steel door that prevents access to the enclosed services. The medical services section also includes a sub-door made of a transparent, shatterproof polymer, such as polycarbonate. Thus, the clear cover panel permits visual access to the gauges and controls for the services, but prevents unauthorized physical access to them. The column is entirely enclosed in a protective casing made out of rolled steel. Doors are provided in the casing for providing access b authorized personnel only to the internal medical services section.

14 Claims, 8 Drawing Sheets

MODULAR MEDICAL SERVICES UNIT WITH SECURE CONSOLE

CROSS-REFERENCE TO RELATED APPLICATIONS

This application is a continuation of co-pending application Ser. No. 12/100,862, filed Apr. 10, 2008, entitled "Modular Medical Services Unit with Secure Console," which claims the benefit of provisional application Ser. No. 60/910,862, filed Apr. 10, 2007, entitled "Modular Medical Services Unit with Secure Console." The contents of both these prior application are incorporated herein by reference.

FIELD OF THE INVENTION

The present invention relates to devices for providing medical services such as gas, vacuum, electrical, communication, data and other services, to medical treatment facilities.

BACKGROUND OF THE INVENTION

Correctional and psychiatric medical facilities require special equipment restricting patient/visitor access to services such as electricity, vacuum, medical gases, communications and supplies. Attempts to bypass the restrictions can sometimes be abated with a simple locked panel, but some attempts can be extreme, violent challenges to the security of the module. Additionally, these facilities often prefer to have equipment that does not facilitate or enable suicide or self-injury attempts with protruding fasteners/hardware or sharp edges and the like. The present invention provides for the secure restriction of access to these services necessary in these environments.

DETAILED DESCRIPTION OF THE PREFERRED EMBODIMENT(S)

Figure 1A:
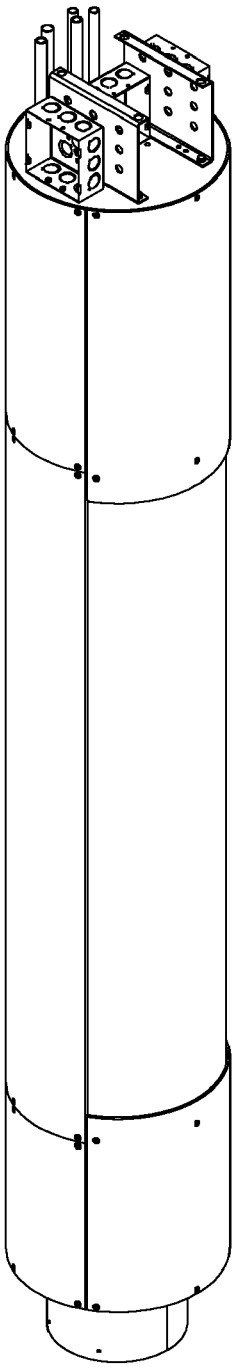
FIG. 1 is a front elevation and isometric view of the module with both doors in the closed position.
Figure 1B:
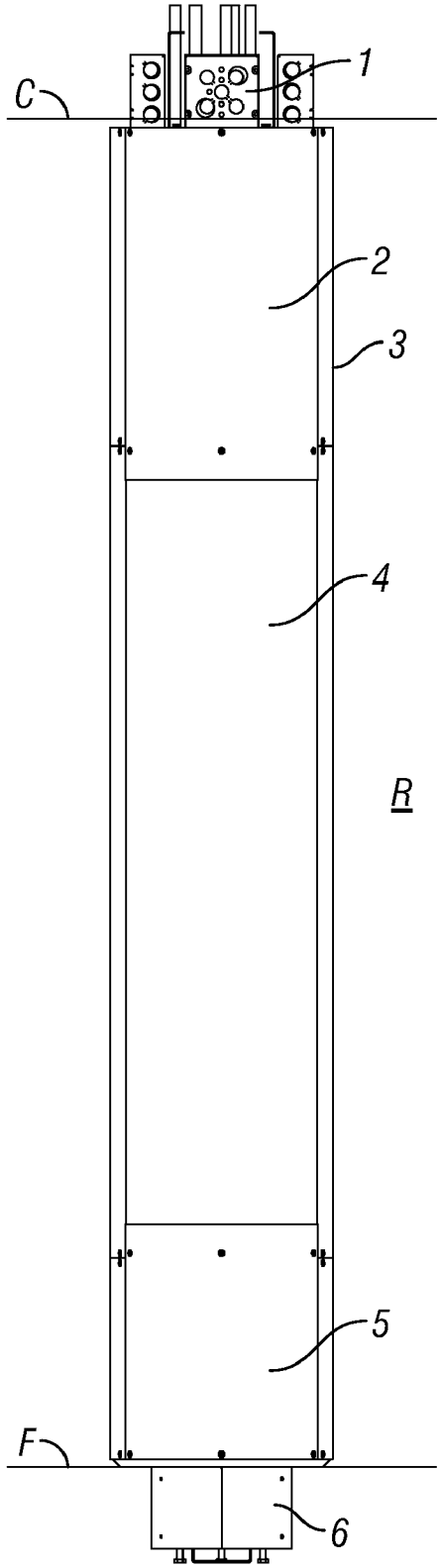
Figure 2A:
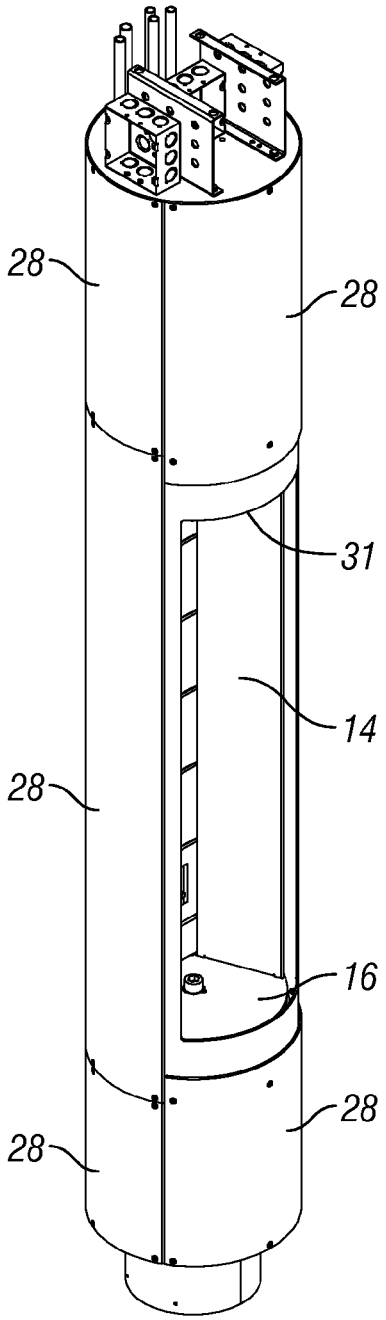
FIG. 2 is a front elevation and isometric view of the module with both doors in the open position exposing the services for use.
Figure 2B:
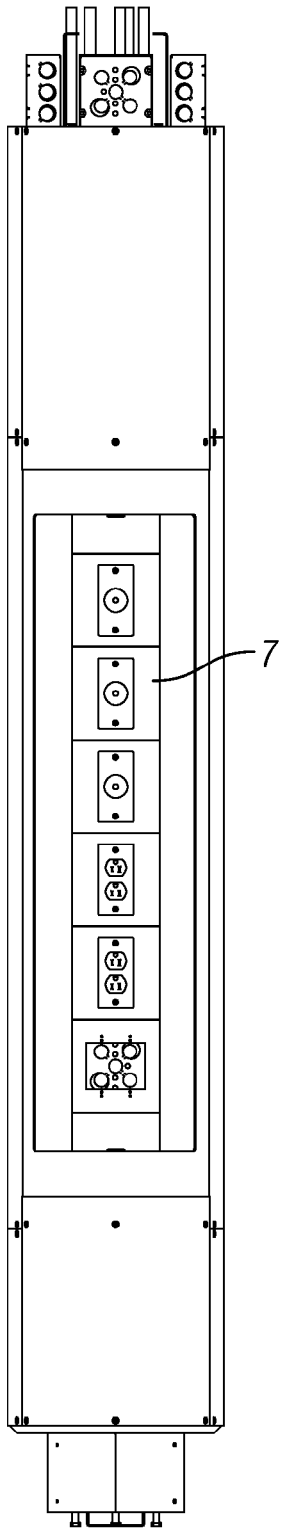
Figure 3:
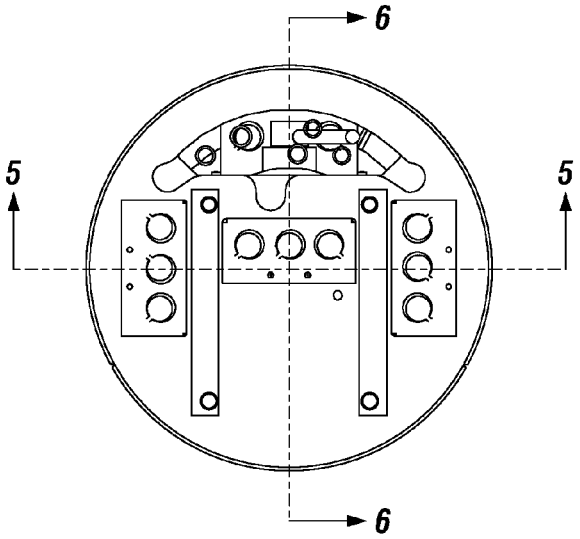
FIG. 3 is a horizontal cross sectional view taken through line E-E of FIG. 4.
Figure 4:
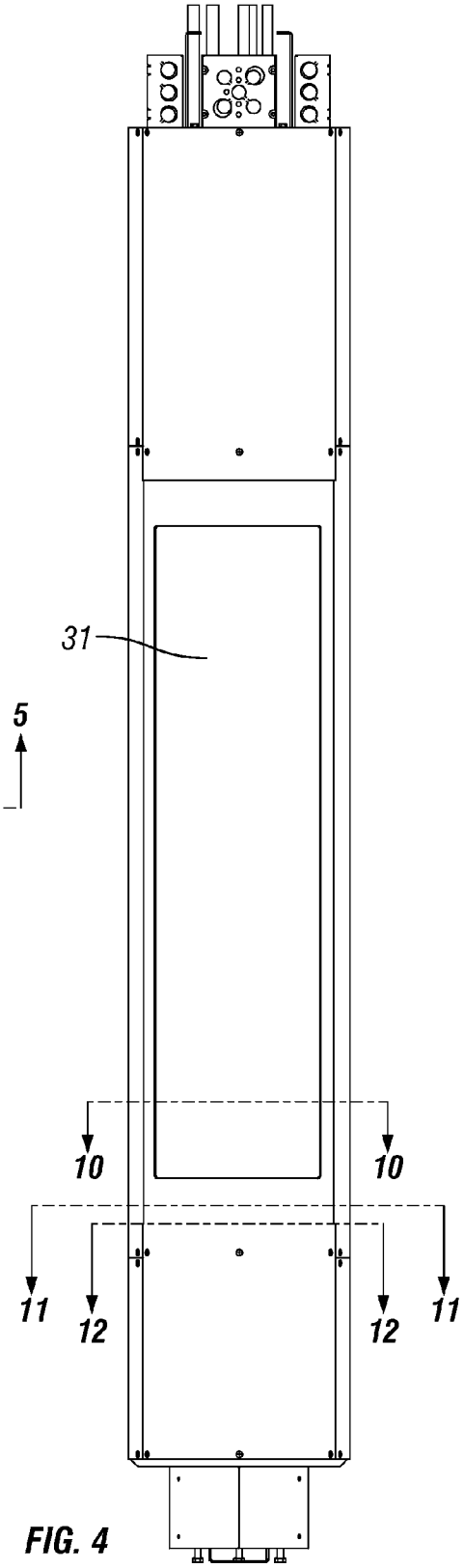
FIG. 4 is a front elevation view of the module with the steel door in the open position and the clear door in the closed position.
Figure 5:
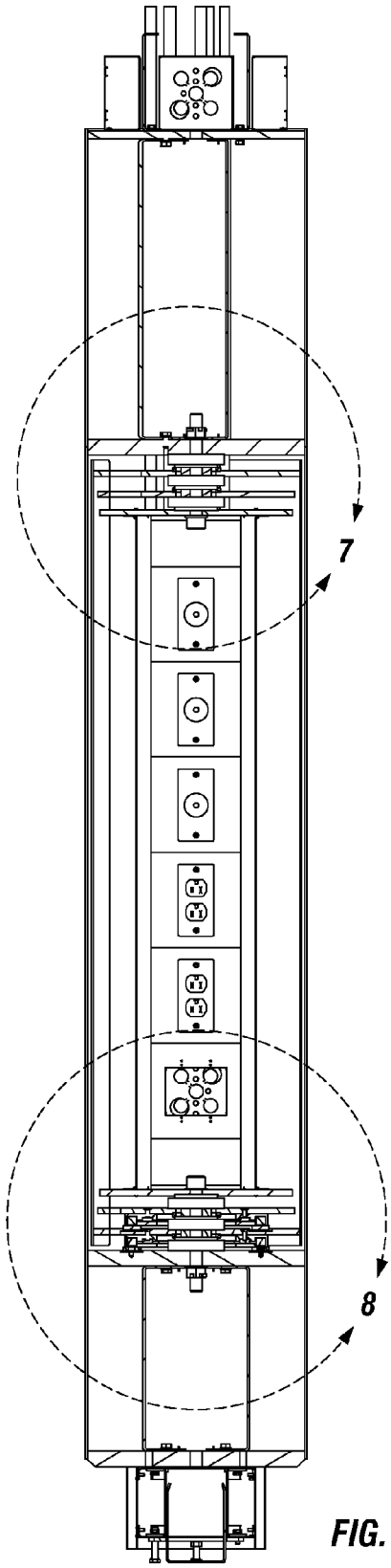
FIG. 5 is a vertical cross sectional front view taken through line A-A of FIG. 3.
Figure 6:
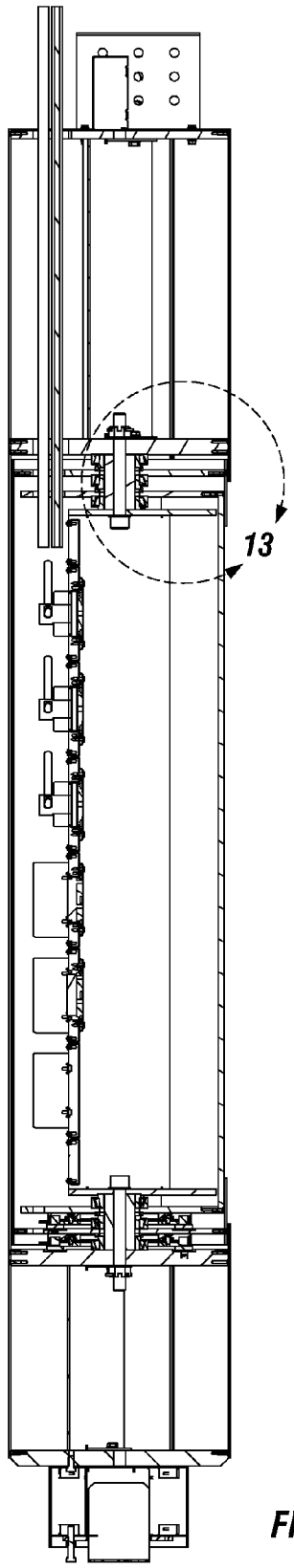
FIG. 6 is a vertical cross sectional side view taken through line H-H of FIG. 3.
Figure 8:
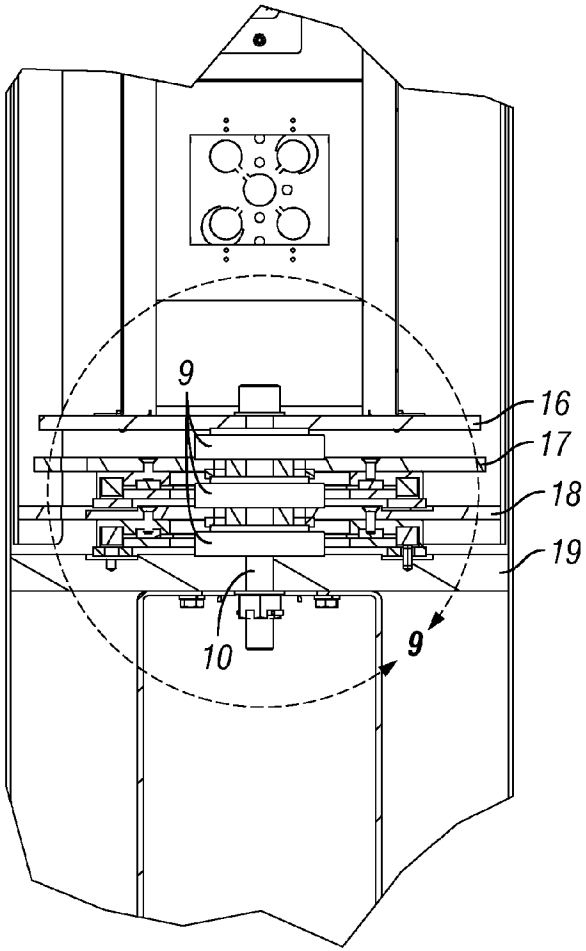
FIG. 8 is a partial vertical cross sectional front view taken through line A-A of FIG. 3 showing the lower bearing assembly components.
Figure 7:
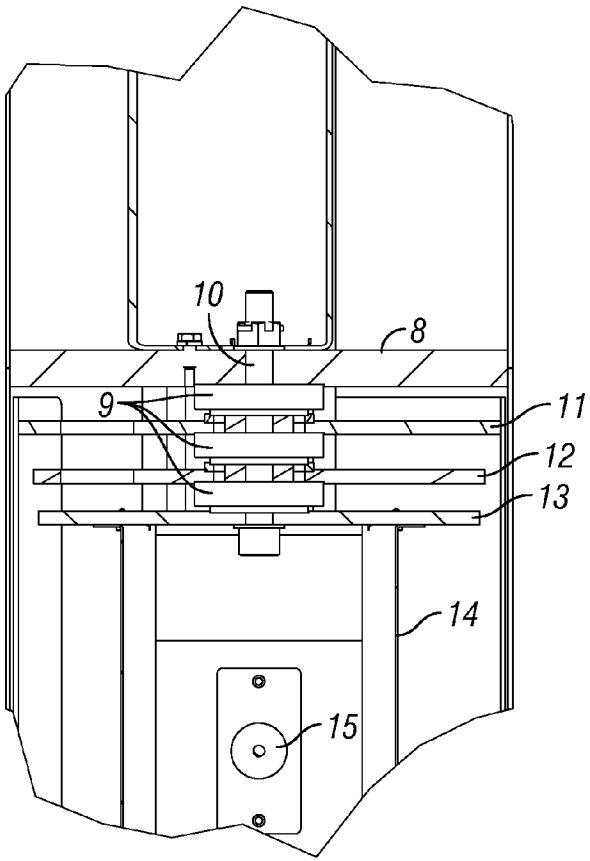
FIG. 7 is a partial vertical cross sectional front view taken through line A-A of FIG. 3 showing the upper bearing assembly components.

With reference now to FIGS. 1 and 2 the present invention comprises a module comprised of a column of components contained within a steel shell. The module is installed in a room "R" extending from floor "F" to ceiling "C". The module is fastened to the floor within the height-adjustable base 6, and anchored above the ceiling line to brackets located within the service connection assembly 1. The outside steel shell of the module is comprised of rolled steel segments 28 completely encasing the column of internal components. When steel door 30 is in the closed position, the module presents a column of steel from floor to ceiling with no openings. All exposed fasteners are of the high-security tamper proof style and therefore the unit presents no vulnerabilities to open, tamper or otherwise damage.

The internal column of components consist of three sections: the upper section 3 providing space for electrical conduit, medical gas pipe, the center section 4 providing space for service outlets and receptacles, medical gas outlets and the like, and the lower section 5 providing space for the unit support structure. As indicated, the system provides access to a variety of medical services. As used herein, "service(s)" or "medical service(s)" refers to all types of gases, liquids, vacuum, power and data lines, including but not limited to oxygen, compressed air, vacuum (suction), electricity, telephone, audio and video signals, and all forms of digital and analog data signals for computer networking and the like.

Figure 9:
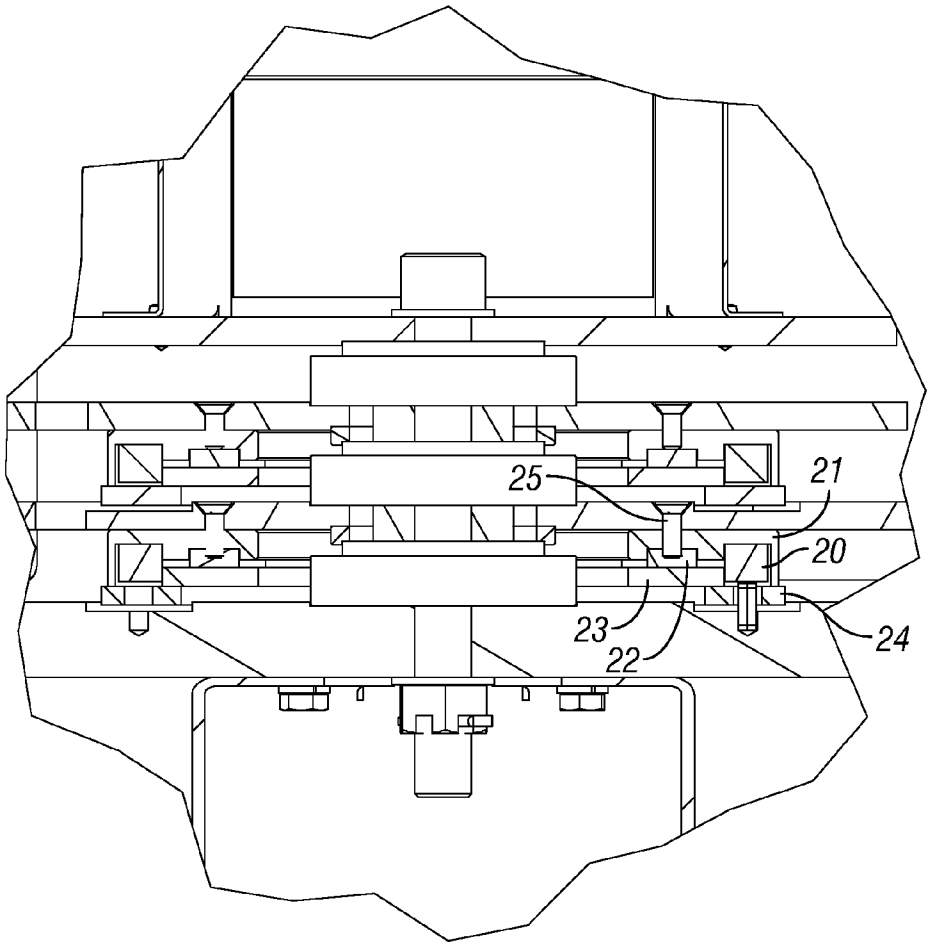
FIG. 9 is a detailed view of FIG. 8 showing the individual electromagnetic brake assembly components.
Figure 11:
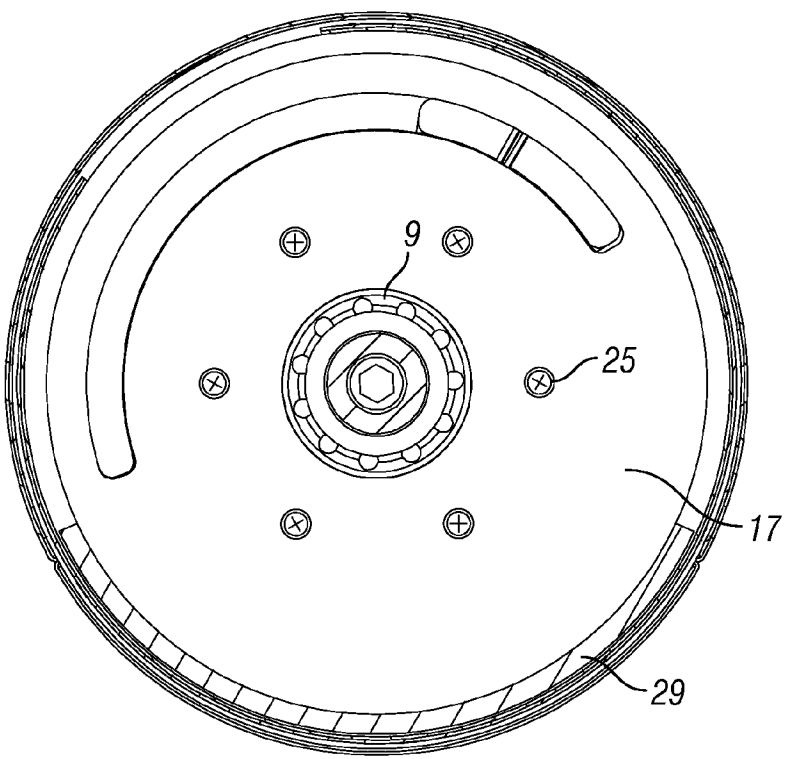
FIG. 11 is a horizontal cross sectional view taken through line F-F of FIG. 4.
Figure 10:
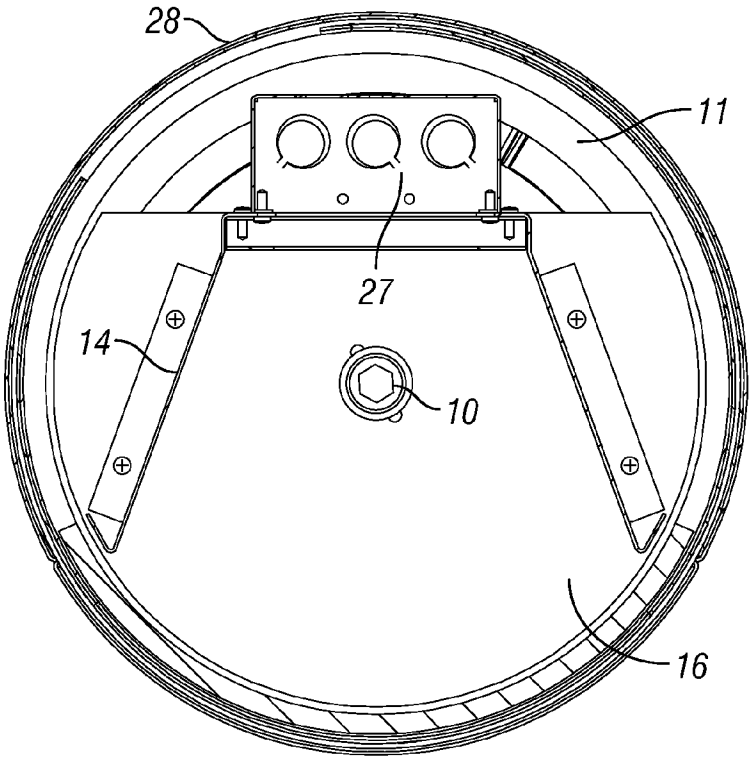
FIG. 10 is a horizontal cross sectional view taken through line E-E of FIG. 4.

In normal use the upper section 3 and lower section 5 are sealed with high-security tamper proof fasteners and not opened after installation. The center section provides the required services via two internally rotating doors. The outer steel door 30 has two positions, the closed position which presents a solid face of steel and secures the unit, and when rotated approximately 120 degrees a face with an access window cut into the steel whose size approximates that of the usable service area inside. A second door 29 behind the steel door 30 provides a clear, lower-security restricted access mode in which medical gas flow rates can be visually confirmed but not accessible to unauthorized personnel. The second clear door 29 is fabricated from an extremely tough, shatterproof clear polymer such as polycarbonate, and has hose clearance notches in the side of it. The clear door 29 rotates approximately 120 degrees in the opposite direction of the steel door 30 to afford complete unrestricted access. Both doors rotate independently and can be locked in any position with their independent respective electromagnetic brake assemblies (FIG. 9). In the preferred embodiment a thickness of no less than 5/16" polycarbonate and 1/8" steel is utilized to ensure denied access even with most hand tools.

Referring now to FIGS. 3-13, the three sections (3, 4, 5) are defined by stators 8 and 19 which are rigidly supported by the steel shell segments 28. Two ends of similar construction to stators 8 and 19 close the module. Sections 3 and 5 provide structural support hardware. The center section 4 contains all of the door hardware, brakes (locking system) and secured services.

Referring to FIG. 5-8, the outer steel door 30 is supported on rotor 18, which is supported by a bearing 9 that rests on stator 19. The outer steel door 30 is attached to the perimeter of rotor 18, and extends upward to rotor 11. Rotor 11 is captured by bearing 9 which is captured by stator 8. This assembly provides for the rolled steel-outer steel door 30 to rotate freely on axles 10 inside of the steel shell 28. The outer steel door 30 has approximately 140 degrees of solid face and an approximately 120 degree window cut in it. The rotation of outer steel door 30 is controlled by the friction on the brake rotor 24 (FIG. 9). When brake coil 20 is not energized, the friction between brake rotor 24 and brake poles 21 and 23 holds rotor 18 stationary via fasteners 25 and therefore prevents the outer steel door 30 from opening (or closing). The friction is produced from the contact of brake rotor 24, brake poles 21 and 23 and magnetic field produced by brake magnets 22. The brake rotor 24 is rotationally locked in position by a pin which engages both the brake rotor 24 and stator 19.

Figure 13:
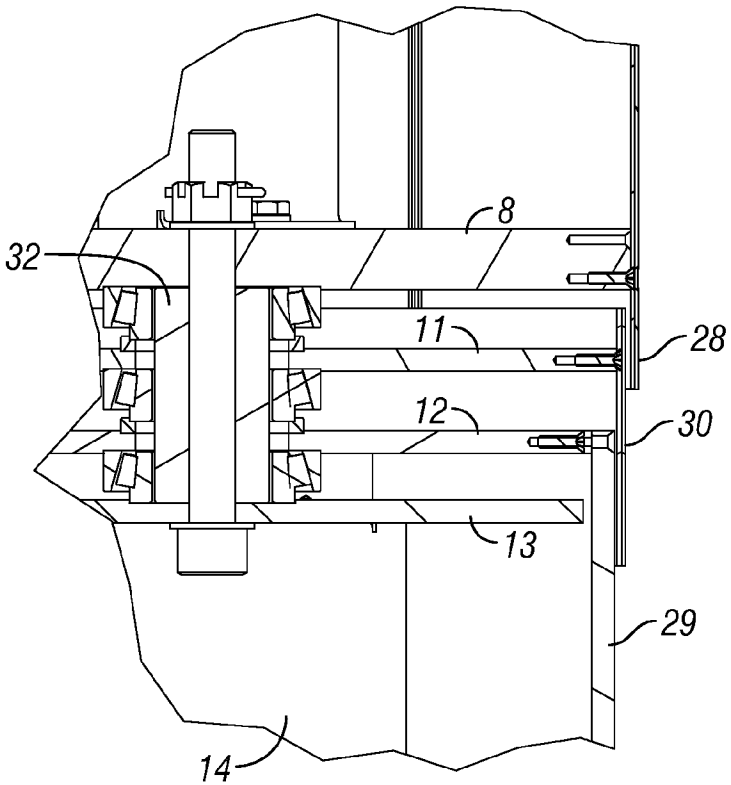
FIG. 13 is detailed view of FIG. 6 showing the relationship of doors and rotors.
Figure 12:
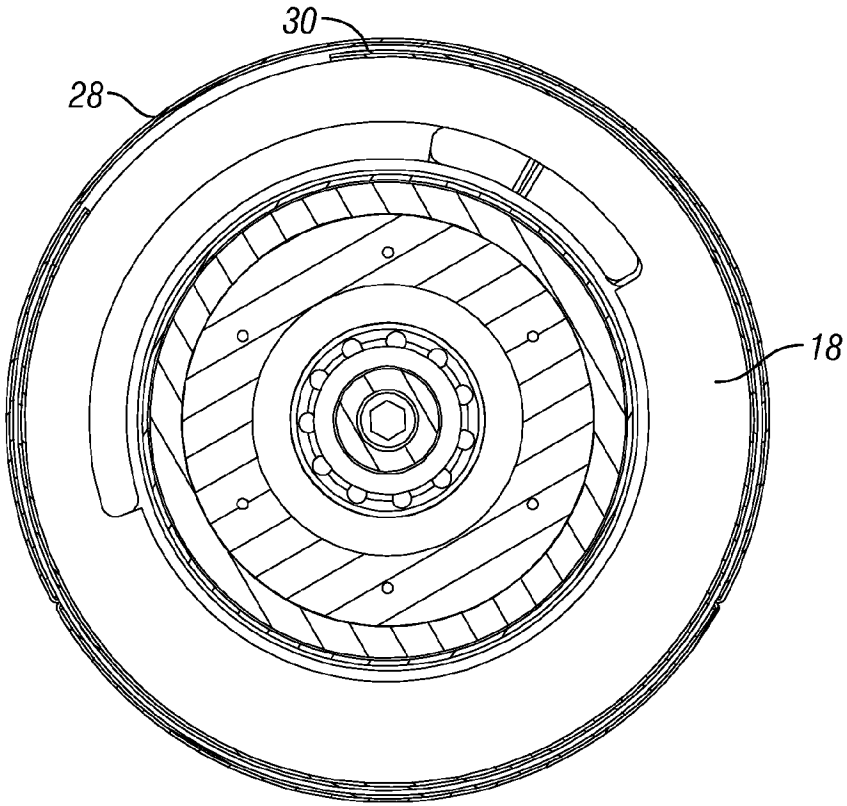
FIG. 12 is a horizontal cross sectional view taken through line G-G of FIG. 4.

The inner clear door 29 is supported on rotor 17 which rests on bearing 9 and the top of rotor 18. The top of rotor 17 is captured by bearing 9 which is captured by sub-stator 16. Sub-stator 16 is rotationally and translationally locked to stator 19 by shaft collar 32 (FIG. 13). The clear door 29 is attached to the perimeter of rotor 17 and extends upward to and is attached to the perimeter of rotor 12. Rotor 12 rests on bearing 9 which is supported by sub-stator 13. Sub-stator 13 is rotationally and translationally locked to stator 8 with shaft collar 32 (FIG. 13). The top of rotor 12 is captured by bearing 9 which is captured by the bottom of rotor 11. This arrangement allows the clear door 29 to rotate freely on axles 10. The clear door 29 is locked in position by rotor 17, when another electromagnetic brake identical to the electromagnetic brake on rotor 18 attached to rotor 17 is de-energized. The clear door 29 is approximately 140 degrees in circumference, which is sufficient to close off the 120 degree window in outer steel door 30.

Electrical receptacles and medical gas outlets are located on formed panel 14 which is attached to both non-rotating sub-stators 13 and 16. Electrical conduit and medical gas piping pass through matched slots in rotors 11 and 12 and stator 8 to reach the service connection area 1. Electrical control wiring for the electromechanical brake assemblies pass through matched slots in rotors 17 and 18 and stator 19. All services are able to run up behind the formed panel 14.

Because the doors 29, 30 have their own respective brakes, they can be locked in any combination of positions dependent upon when the coils of the brakes are de-energized. This arrangement also affords a "locked-down" loss of power mode since power is required to un-lock both doors. Additionally, since the controls are electric, the switch or keyswitch can be located remotely away from the unit, and even outside of the room.

U.S. patent application Ser. No. 12/023,273, entitled "Rotating Medical Services Column," filed Jan. 31, 2008, U.S. Pat. No. 5,644,876, entitled "Modular Medical Gas Services Column," issued Jul. 8, 1997, and U.S. patent application Ser. No. 11/534,398, filed Sep. 22, 2006, entitled "Medical Service Unit on Articulating Arm with Electromagnetic Brakes," have been incorporated herein by reference. In the event of any inconsistency between the present disclosure and any of these prior applications and patents, the present disclosure shall control.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A modular medical services unit comprising:

an elongate cylindrical housing defined by a sidewall having an access opening therein, the access opening extending only partially around the circumference of the sidewall;

a medical services outlet panel supported in the housing and positioned to be accessible through the access opening, the outlet panel comprising a plurality of medical service outlets;

a first solid door formed of non-transparent material, the first door comprising an arced panel defining a window sized to provide physical access to the medical service outlets, wherein the first door is rotatably mounted within the housing for movement between an open position and a closed position, wherein in the open position the window is aligned with the access opening, and wherein in the closed position the door forms a solid face with the housing across the access opening completely blocking visual and physical access to the medical service outlets;

a second door formed of transparent material, the second door comprising an arced panel sized to be at least coextensive with the window in the first door, wherein the second door is rotatably mounted within the housing for movement between an open position and a closed position, wherein in the open position the second door is inside the housing leaving open the window in the first door when the window is aligned with the access opening to allow physical access to the medical service outlets in the outlet panel, and wherein in the closed position the second door spans the window in the first door when the window is aligned with the access opening providing visual access to the medical service outlets in the outlet panel but blocking physical access thereto.

2. The unit of claim 1 wherein the access opening extends only about 120 degrees around the circumference of the sidewall.

3. The unit of claim 1 wherein the housing is formed of steel.

4. The unit of claim 3 wherein the first door is formed of steel.

5. The unit of claim 4 wherein the second door is formed of shatterproof polymer.

6. The unit of claim 5 wherein the polymer is polycarbonate.

7. The unit of claim 1 wherein the housing and the first door are formed of steel and the second door is formed of polycarbonate.

8. The unit of claim 1 wherein the housing extends from floor to ceiling and comprises a base section for attaching the housing to a floor and an upper connecting section for attaching the housing to a ceiling opposite the floor.

9. The unit of claim 1 wherein the first and second doors rotate in directions opposite to each other.

10. The unit of claim 1 wherein the housing comprises upper and lower rotor assemblies for providing independent rotation and positioning of the first and second doors within the housing.

11. The unit of claim 10 wherein the housing further comprises electromagnetic brake assemblies for controlling the movement of the first and second doors.

12. The unit of claim 11 wherein the electromagnetic brake assemblies are adapted to brake when the brake coil is energized and to release when the coil is de-energized.

13. The unit of claim 12 wherein the electromagnetic brakes are remotely operable.

14. The unit of claim 1 wherein the window in the first door is about 120 degrees in circumference and wherein the second door is about 140 degrees in circumference.

* * * * *